United States Patent [19]

Arai

[11] Patent Number: 4,920,585

[45] Date of Patent: May 1, 1990

[54] SHIELD MOUNTING ASSEMBLY FOR A SAFETY HELMET

[76] Inventor: Michio Arai, 1-164, Horinouchi, Ohmiya-shi, Saitama-Ken, Japan

[21] Appl. No.: 255,861

[22] Filed: Oct. 11, 1988

Related U.S. Application Data

[63] Continuation-in-part of Ser. No. 198,516, May 25, 1988.

[30] Foreign Application Priority Data

Oct. 20, 1987 [JP] Japan ..... 62-160951[U]

[51] Int. Cl.[5] ..... A42B 3/02

[52] U.S. Cl. ..... 2/424

[58] Field of Search ..... 2/6, 424, 425, 10

[56] References Cited

U.S. PATENT DOCUMENTS 4,507,809 4/1985 Stepan ..... 2/424
4,615,052 10/1986 Nava ..... 2/424
4,718,127 1/1988 Rittmann ..... 2/424
4,748,696 6/1988 Fohl ..... 2/425 X

*Primary Examiner*—Werner H. Schroeder
*Attorney, Agent, or Firm*—Klauber & Jackson

[57] ABSTRACT

A safety helmet includes a helmet body having left and right outer sides, a shield rotatably supported on the left and right outer sides of the helmet body, engaging base plates or screws which rotatably support the shield on the left and right outer sides of the helmet body, shield keep covers detachably connected to the left and right outer sides of the helmet body in covering relation to the engagement base plates or screws, and a flexible string of a predetermined length which connects each shield keeper cover to the helmet body directly or through the engagement base plate.

9 Claims, 5 Drawing Sheets

SHIELD MOUNTING ASSEMBLY FOR A SAFETY HELMET

REFERENCE TO RELATED APPLICATION

This application is a continuation-in-part U.S. patent Application Ser. No. 07/198,516, filed May 25, 1988, to the same inventor herein and entitled, SHIELD MOUNTING ASSEMBLY FOR A SAFETY HELMET.

BACKGROUND OF THE INVENTION

The present invention relates to an assembly for mounting a shield on a safety helmet having a full-face type or jet type configuration which is used when riding a motorcycle or driving an automobile.

In a conventional shield mounting construction for a safety helmet having a full-face type or jet type configuration, the shield and an opening adjustment means for the shield are generally mounted by screws to the helmet body. More specifically, left and right sides of the shield and parts of the opening adjustment means, such as a ratchet mechanism, are fixedly mounted to the helmet body through a mounting cover.

With the above-mentioned conventional construction, it is sometimes necessary to disassemble a mounting portion of the shield because the shield does not open and close correctly during use. In such case, when the screws are removed to remove the shield keeper cover from the helmet body, various parts thereof which limit the opening and closing of the shield, fall apart in a disorderly manner. As a result, these parts may be lost.

Further, when the shield keeper cover is completely removed from the helmet body, it may be damaged or broken if it falls. Also, since it is disengaged, if it becomes lost, mounting of the shield then becomes impossible.

OBJECTS AND SUMMARY OF THE INVENTION

Accordingly, it is an object of the present invention to provide a mounting construction for a shield of a safety helmet that overcomes the aforementioned problems in the prior art.

It is another object of the present invention to provide such a mounting construction in which the shield can be engaged with and held on the helmet body without the use of screws.

It is still another object of the invention to provide such a mounting construction in which mounting and removal of the shield keeper cover and shield can be performed only when the shield is moved to a predetermined position.

It is yet another object of the invention to provide such a mounting construction in which, even if the shield keeper cover and shield are removed from the helmet body, support members for the shield do not fall apart in pieces.

According to the present invention, even if means for locking the shield keeper cover is removed so as to mount or remove the shield, the shield keeper cover does not completely separate from the helmet body.

The means provided by the present invention for achieving this object is a flexible string member having a predetermined length, with one end connected to the shield keeper cover, and the other end connected to the helmet body or to a member on the helmet body. In the latter case, the member may or may not be provided with the function of supporting the shield on the helmet body.

The aforesaid string member comprises strings which are formed by twisting plastic strings, metal wires, rubber strings, fiber yarns or the like.

According to the above-described construction, the left and right sides of the shield are engaged by screws or the like which are screwed into tapped holes formed in the engaging base plate members which support the shield on the left and right sides of the helmet body, or in the helmet body itself. Such engaged portions are covered with and protected by shield keeper covers. When the means for locking a shield keeper cover is removed, the shield may be separated from the engaging base plate members or from the helmet body itself. However, since each shield keeper cover is connected by a string member to an engaging base plate member or to the helmet body itself, the shield keeper cover is always held with the helmet body.

In accordance with an aspect of the present invention, a safety helmet includes a helmet body having left and right outer sides; a shield rotatably supported on said left and right outer sides of said helmet body; support means for rotatably supporting said shield on said left and right outer sides of said helmet body; shield keeper covers detachably connected to said left and right outer sides of said helmet body in covering relation to said support means; and flexible string means of a predetermined length for connecting each said shield keeper cover to said helmet body.

The above and other objects, features and advantages of the present invention will become readily apparent from the following detailed description thereof which is to be read in connection with the accompanying drawings.

DETAILED DESCRIPTION OF A PREFERRED EMBODIMENT

Figure 1:
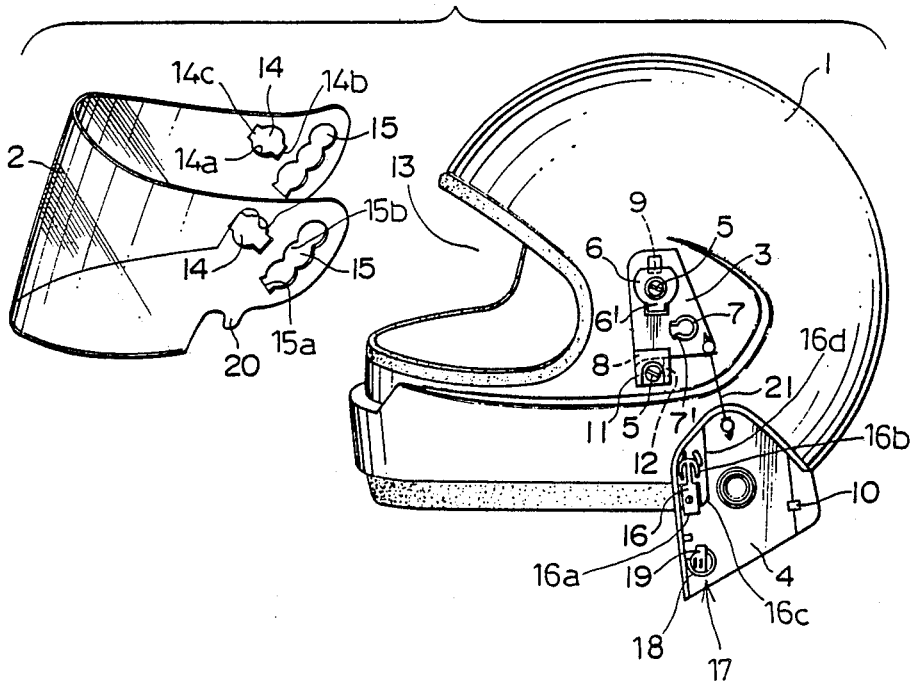
FIG. 1 is an exploded perspective view of a helmet according to the present invention.
Figure 2:
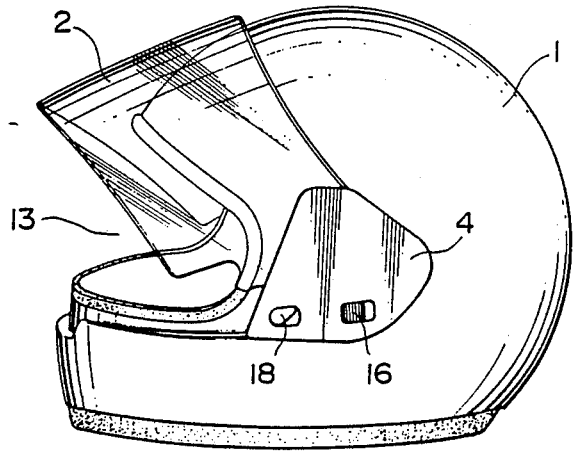
FIG. 2 is a perspective view of the helmet of FIG. 1, shown in assembled condition.
Figure 3:
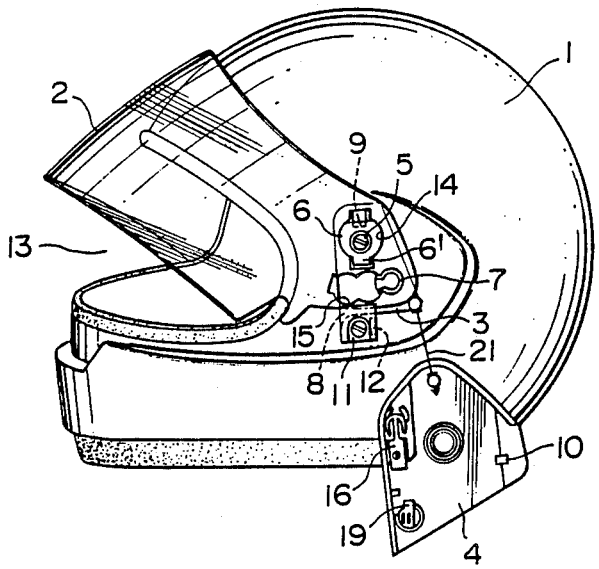
FIG. 3 is a perspective view of the helmet of FIG. 1, showing the shield keeper cover disassembled from the helmet, but connected by means of a string.

An embodiment of a mounting construction for a shield of a safety helmet according to the present invention will now be described with reference to the drawings, in which there is shown a helmet body 1, a shield 2, an engaging base plate 3 secured to left and right outer surfaces of helmet body 1, and a shield keeper cover 4.

Helmet body 1 is shown with a full-face type configuration, which is generally known. However, helmet body 1 can have a jet type configuration. Engaging base plates 3 are provided to support shield 2 and are fixed by screws 5 to the left and right outer sides of helmet body 1. Each engaging base plate 3 is integrally provided with a rotation axle 6 about which shield 2 is rotated, a resilient engaging piece 7 for limiting rotation of shield 2 and a groove 8 into which the lower peripheral edge of shield 2 fits, resilient engaging piece 7 being disposed below rotation axle 6, and groove 8 disposed further below thereof. Each engaging base plate 3 can be molded of either synthetic resin or a metal. In the case where engaging base plates 3 are formed of synthetic resin, a moderating means for limiting rotation of shield 2 can additionally be integrally formed therewith.

Figure 12:
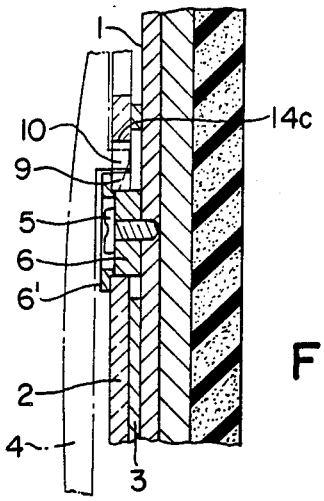
FIG. 12 is a cross-sectional view of the mounting assembly of FIG. 3, taken along line 12—12 thereof.

Rotation axle 6 includes a projecting piece 6' formed opposite to the upper cut-off straight line surface of rotation axle 6. The projected height of rotation axle 6 is about twice that of the plate thickness of shield 2, such that projecting piece 6' which projects from the outer peripheral surface of rotation axle 6 extends to a position above the plate thickness of shield 2, as best shown in FIG. 12. Rotation axle 6 is formed at its central portion with a through hole into which a screw 5 is inserted. Further, rotation axle 6 is formed on the side of the upper straight line surface with an engaging recess 9, which receives an engaging projecting portion 10 of shield keeper cover 4.

Resilient engaging piece 7 is formed into an approximately C-shape by cutting off a part of a circular ring. A part of the outer peripheral surface of resilient engaging piece 7 is connected to base plate 3, and a pawl portion 7' is integrally formed at opposite ends of resilient engaging piece 7 and is directed radially outwardly.

Groove 8 is positioned at the lower end of base plate 3 and has a width capable of receiving the plate thickness of shield 2. Specifically, the upper and both left and right sides of groove 8 are open, such that the lower peripheral edge of shield 2 is inserted in groove 8 from the top thereof and guided in a lateral direction.

An extension 11 formed with a through hole for receiving a screw 5 is integrally formed at the lower part of each engaging base plate 3, and an engaging hole 12 is formed in a rear, external end portion of extension 11.

Shield 2 opens and closes a front opening or window hole 13 formed in the front surface of helmet body 1 and is formed from a transparent, translucent or colored transparent synthetic resin plate which is adjusted to the curved shape of helmet body 1. Shield 2 is formed at both left and right sides thereof with a mounting hole 14 through which rotation axle 6 and projecting piece 6' fit, and an arcuate guide hole 15 which receives resilient engaging piece 7 to determine the range of rotation of shield 2.

Mounting hole 14 is continuously formed with a circular hole **14*a* slightly larger than the outer diameter of axle 6 and a notch 14*b* at the lower hole edge of hole 14*a* which receives projecting piece 6'. Hole 14*a* is also continuously formed at the upper peripheral edge thereof with a notch 14*c* which receives engaging projecting portion 10 formed on shield keeper cover 4 when shield 2** is moved to its upper limit position.

Arcuate guide hole 15 determines the range of rotation of shield 2 and is formed arcuately in surrounding relation about mounting hole 14. Guide hole 15 is formed with a fitting portion **15*a* at one end thereof, fitting portion 15*a* engaged with pawl 7' of resilient engaging piece 7 when shield 2 is closed. The width of arcuate guide hole 15 is slightly narrower than the outside diameter of resilient piece 7 when no external force is exerted. A depression 15*b* is formed halfway along guide hole 15. Accordingly, when shield 2 is rotated so that depression 15*b* in guide hole 15 assumes the position of resilient engaging piece 7, the inwardly compressed resilient engaging piece 7 expands into its no-load shape and fits into depression 15*b*. Therefore, shield 2 is engaged and held at a predetermined open position. Thus, shield 2** can be opened and closed in a stepwise manner.

Shield keeper cover 4 for covering the support portion of shield 2 is formed of a synthetic resin material, and engaging projecting portion 10 is integrally formed at the upper part of the inner surface thereof in opposing relation to shield 2. In addition, a stopper 16 is mounted at the lower part of the inner surface so that it may be operated from the outside.

Engaging projecting portion 10 fits into and engages with engaging recess 9 formed in the upper side of rotation axle 6 of engaging base plate 3, engaging projecting portion 10 fitting into and disengaging from engaging recess 9 through notch **14*c* formed in the upper peripheral edge of mounting hole 14*a* when rotation axle 6 registers with mounting hole 14*a* of shield 2, that is, in the fully open limit position of shield 2**.

Stopper 16 is in the form of a rectangular flat plate **16*a* and the rear end thereof fits into and disengages from engaging hole 12. At the opposite front side thereof, stopper 16 is projectingly formed with a spring-action piece 16*b* in the form of an arrow for biasing plate 16*a* of stopper 16 in a direction of being fit into engaging hole 12 at all times. The thus formed plate 16*a* of stopper 16 fits into a guide piece 16*c* formed in the back of shield keeper cover 4, and spring-action piece 16*b* thereof fits into a guide piece 16*d* that narrows toward the rear of shield keeper cover 4. When spring-action piece 16*b* is moved in the direction of the narrowing width its guide piece 16*d*, spring-action piece 16*b* is inwardly pressed to store a bias force. When the rearwardly moving force is released, plate 16*a* of stopper 16 is thereby moved by such stored bias force in the opposite direction so as to automatically engage and fit into engaging hole 12**.

A lock mechanism 17 is mounted on shield keeper cover 4 for maintaining shield 2 in a closed position. Lock mechanism 17 is composed of a lock cam 19 which rotates integral with an operating lever 18 on shield keeper cover 4, and an engaging portion 20 of shield 2 which can be engaged with and disengaged from lock cam 19.

Shield keeper cover 4 is connected to engaging base plate 3 which is secured to helmet body 1, by a flexible connecting string 21, for example, a string formed of synthetic resin, to prevent shield keeper cover 4 from being completely separated when shield keeper cover 4 is disassembled. When shield keeper cover 4 is assembled on helmet body 1, string 21 is accommodated internally of shield keeper cover 4.

Next, mounting of shield 2 will be described. First, the left and right sides of shield 2 are engaged with and supported on engaging base plates 3 secured to helmet body 1, such support thereof being set by fitting the lower peripheral edge of shield 2 into groove 8 and fitting and registering mounting hole 14 and circular guide hole 15 onto axle 6 and resilient engaging piece 7, respectively. In such case, shield 2 is in its upper open limit position.

Thereafter, engaging projecting portion 10 of shield keeper cover 4 is fitted into and engaged with engaging recess 9 on the upper side of axle 6 through notch **14*c* formed in the edge of mounting hole 14 of shield 2. Stopper 16 provided at the underside of shield keeper cover 4 is biased and fits into engaging hole 12 formed at the lower part of engaging base plate 3 by means of an operating member on shield keeper cover 4 so that shield keeper cover 4 and engaging base plate 3 are integrally engaged and held with each other, thus completing the mounting of shield 2. Thereafter, shield 2** is closed for use.

To remove shield 2, shield 2 is rotated upwardly so that mounting hole 14 is placed in registration with axle 6, and in that state, stopper 16 provided on shield keeper cover 4 is pulled out of engaging hole 12, and shield keeper cover 4 is raised upwardly so as to be pulled out of helmet body 1. Engaging projecting portion 10 is then removed from engaging recess 9 through notch **14*c* whereby shield keeper cover 4 may be removed. Thereafter, shield 2 can be disengaged from engaging base plate 3**.

Thus, with the present invention, shield 2 may be mounted for limited rotation by engagement between engaging base plates 3 secured to the sides of helmet 1 and shield keeper covers 4, without the use of screws. Further, since such support is accomplished by engaging base plates 3 secured to the sides of helmet 1 and shield keeper covers 4 which can be engaged and disengaged therefrom, even if shield keeper covers 4 are removed from engaging base plates 3 to remove shield 2, such supporting members do not completely separate from each other, that is, do not fall apart in pieces, so that shield 2 may be engaged and disengaged safely. Moreover, since the mounting and removal of shield 2 and shield keeper covers 4 can be effected only when shield 2 is rotated to its upper limit position, shield keeper covers 4 and shield 2 are opposed to each other when shield 2 is fully closed, to prevent disengagement thereof. Therefore, there is no possible disengagement of shield 2 in such position.

In the above-described shield mounting construction, shield 2 is rotatably held by engaging base plates 3 and shield keeper covers 4. However, in a conventional construction using screws for connecting the shield directly to the helmet body, engaging base plates 3 can be eliminated. In such case, a cover covers an engaging portion of the shield and the helmet body in a similar manner to shield keeper covers 4. These specific constructions will be described hereinafter with reference to FIGS. 4 to 6.

Figure 4:
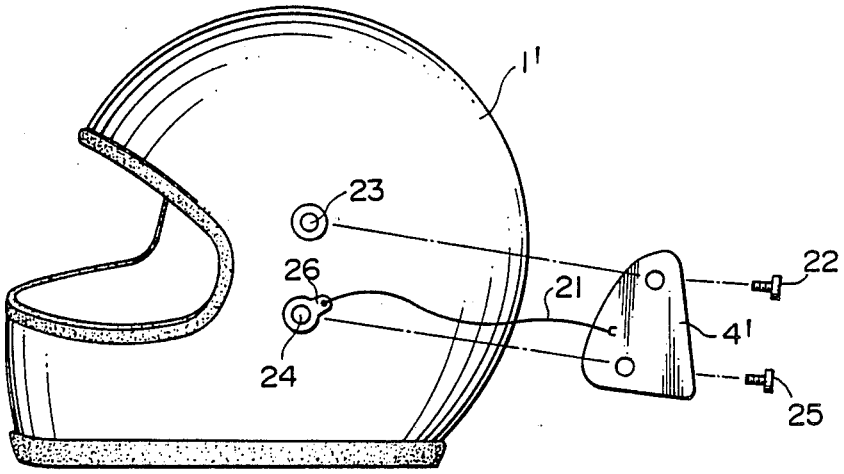
FIG. 4 is an exploded perspective view of a helmet according to another embodiment of the present invention.

Referring to FIG. 4, a helmet is provided in which a shield 2' is mounted with respect to a helmet body 1' by means of screws. Specifically, a hole 23 for screw-threadedly receiving a screw 22 which rotatably supports the left and right sides of shield 2' is formed in the left and right sides of helmet body 1'. A tapped hole 24 for fixing a shield keeper cover 4' in covering relation over shield 2 is formed below tapped hole 23, whereby shield keeper cover 4' is fixed at two points, one for screw 22 that supports shield 2' and the other by a screw 25 that functions as a stop for shield keeper cover 4'.

In such case, the means for always maintaining shield keeper cover 4' connected to helmet body 1' is string member 21 that is connected to a washer 26 which is fixed by adhesives or the like to the surface surrounding tapped hole 24 on helmet body 1. Thus, a member which is not provided with the function of supporting the shield on helmet body 1, and string 21 provided on the back of shield keep cover 4', always maintains shield keep cover 4' connected to helmet body 1'. In the state where shield 2' is mounted, string member 21 is thus stored within shield keep cover 4'; and fixed by suitable means, such as a screw, to washer 26.

Figure 5:
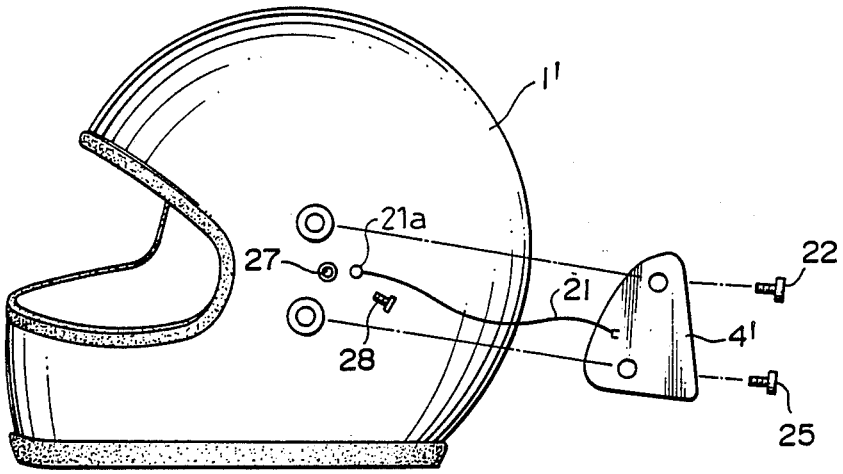
FIG. 5 is an exploded view of a helmet according to another embodiment of the present invention.

Referring to FIG. 5, a tapped hole 27 for locking a connection end of string member 21 with the helmet body is formed separately from the tapped holes which receive screws 22 and 25 for locking shield 2' and shield keep cover 4' to helmet body 1'. In such case, an annular portion **21*a* formed at the connection end of string member 21 fits coaxially with tapped hole 27 and a screw 28 is inserted through annular portion 21*a* and screwed in tapped hole 27** to secure the connection end thereat.

Figure 6:
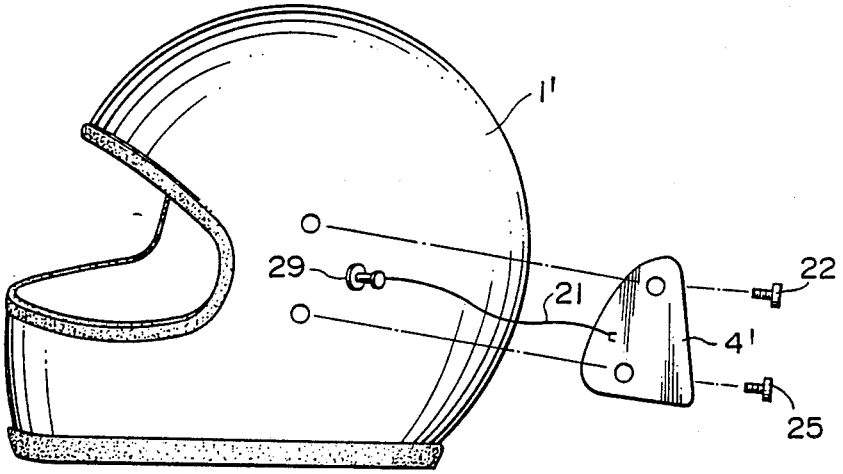
FIG. 6 is an exploded view of a helmet according to another embodiment of the present invention.
Figure 7:
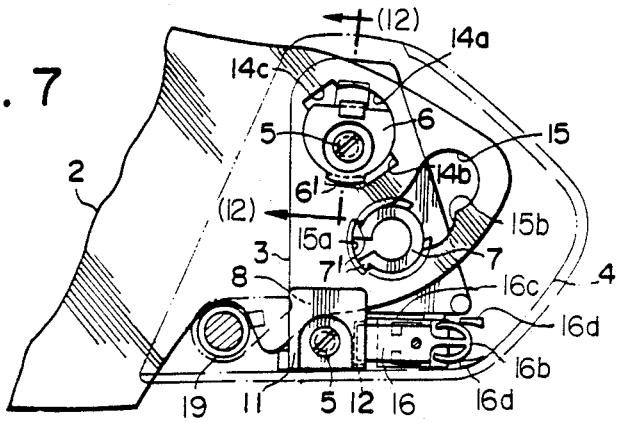
FIG. 7 is an enlarged plan view, partly in phantom, of the mounting assembly of the helmet of FIG. 1, showing the shield in a fully closed position.
Figure 8:
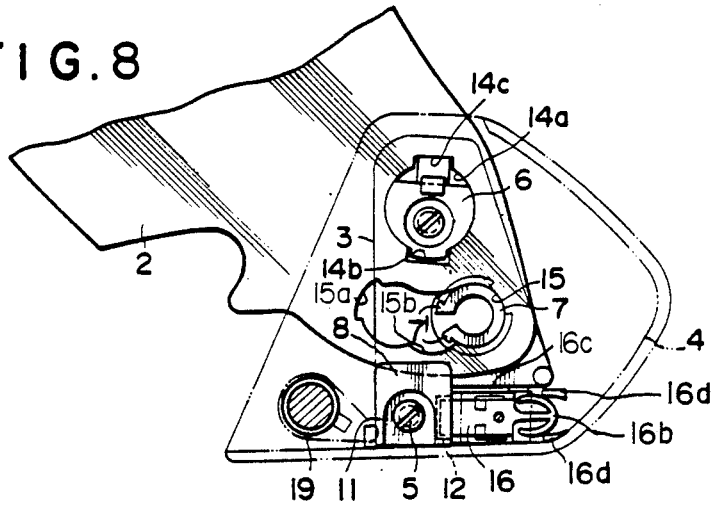
FIG. 8 is an enlarged plan view, partly in phantom, of the mounting assembly of FIG. 3, showing the shield in a fully opened position, and the stopper engaged with the engaging hole.
Figure 9:
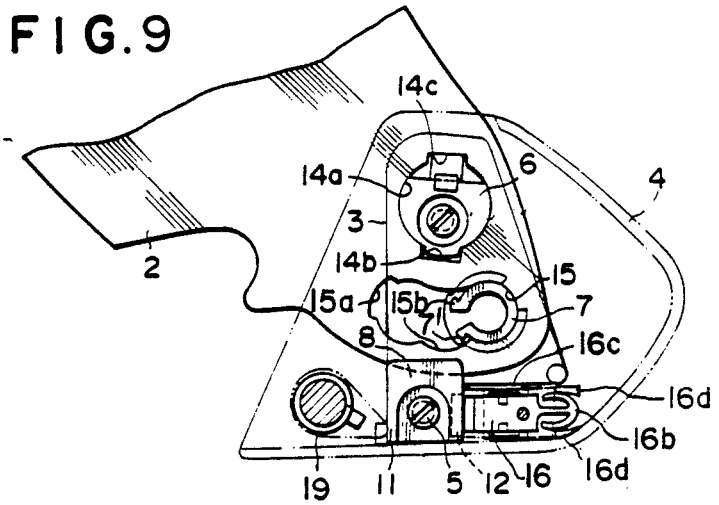
FIG. 9 is an enlarged plan view, partly in phantom, of the mounting assembly of FIG. 3, showing the shield in a fully opened position, with the stopper being removed from the engaging hole.
Figure 10:
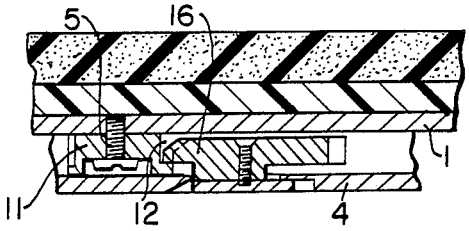
FIG. 10 is a cross-sectional view of a portion of the helmet of FIG. 1, showing the stopper of the shield keep cover engaged in the engaging hole of the engaging base plate.
Figure 11:
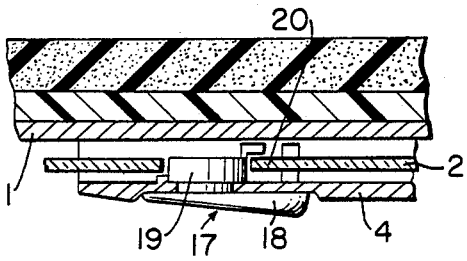
FIG. 11 is a cross-sectional view of a portion of a helmet of FIG. 1, showing the lock mechanism for maintaining the shield in its fully closed position.

In an alternative embodiment, as shown in FIG. 6, a string connecting means 29 is secured by means of a dual face adhesive or the like to helmet body 1', and a connecting end of string member 21 is connected to helmet body 1' through string connecting means 29.

As described above, the present invention provides a helmet in which left and right sides of a shield are rotatably supported on left and right outer sides of a helmet body, a shield keep cover is covered over and secured to a supporting portion of the helmet body, and the shield keep cover is removable to mount and remove the shield from the helmet body. One end of a flexible string member having a predetermined length is connected to the shield keep cover, the other end of the string member being connected and secured to the helmet body. The latter member could also have the function of supporting the shield on the helmet body. With this arrangement, even if the shield keep cover is separated from the helmet body in order to check the condition of rotation of the shield or replace the shield, since the shield keep cover is connected by the string member to the helmet body, either directly or indirectly, it does not completely separate from the helmet body, but rather, is always held together therewith. Accordingly, during the inspection or replacement of the shield, the shield keep cover does not fall or break so that such inconvenience in mounting the shield is positively overcome. Moreover, in the case where the means for locking the shield on the helmet body or the moderating means is provided on the shield keep cover, these parts do not disengage therefrom and are not lost. Moreover, since the string member has a flexibility and is stored within the shield keep cover, it does not project in the form of a loop outside the helmet, and thus, there is no possibility that it can be caught by other articles.

Having described specific preferred embodiments of the invention with reference to the accompanying drawings, it will be appreciated that the present invention is not limited to those precise embodiments, and that various changes and modifications can be effected therein by one of ordinary skill in the art without departing from the spirit or scope of the invention, as defined by the appended claims.

What is claimed is:

1. A safety helmet comprising:

(a) a helmet body having left and right outer sides;

(b) a shield rotatably supported on said left and right outer sides of said helmet body;

(c) support means for rotatably supporting said shield on said left and right outer sides of said helmet body;

(d) shield keep covers detachably connected to said left and right outer sides of said helmet body; and (e) flexible string means of a predetermined length for connecting each said shield keep cover to said helmet body, said string means being completely contained and unexposed between said helmet body and said shield keep covers when the shield keep covers are connected to the outer sides of the helmet body.

2. A safety helmet according to claim 1; wherein said flexible string means is connected between each said shield keep cover and said support means.

3. A safety helmet according to claim 2; wherein said support means includes engaging base plates secured to left and right outer sides of the helmet body, and each shield keep cover is detachably connected to an engaging base plate by screw means and is always connected to said engaging base plate by said flexible string means.

4. A safety helmet according to claim 1; further including at least one screw-threaded aperture for rotatably securing said shield on said helmet body and for securing each shield keep cover to said helmet body, and further including means for securing said flexible string means to said helmet body.

5. A safety helmet comprising:

(a) a helmet body having left and right outer sides;

(b) a shield rotatably supported on said left and right outer sides of said helmet body;

(c) support means for rotatably supporting said shield on said left and right outer sides of said helmet body;

(d) shield keep covers detachably connected to said left and right outer sides of said helmet body;

(e) flexible string means of a predetermined length for connecting each said shield keep cover to said helmet body;

(f) said support means including at least one screw-threaded aperture in said helmet body which receives screw means for rotatably securing said shield on said helmet body and for securing each shield keep cover to said helmet body; and (g) means for securing said flexible string means to said helmet body, said means for securing including washer means associated with one said screw-threaded aperture and secured to said helmet body for connecting one end of said flexible string means to said helmet body.

6. A safety helmet according to claim 5; wherein said washer means is secured to said helmet body in surrounding relation to said one screw-threaded aperture.

7. A safety helmet comprising:

(a) a helmet body having left and right outer sides;

(b) a shield rotatably supported on said left and right outer sides of said helmet body;

(c) support means for rotatably supporting said shield on said left and right outer sides of said helmet body;

(d) shield keep covers detachably connected to said left and right outer sides of said helmet body;

(e) flexible string means of a predetermined length for connecting each said shield keep cover to said helmet body;

(f) said support means including at least one screw-threaded aperture in said helmet body which receives screw means for rotatably securing said shield on said helmet body and for securing each shield keep cover to said helmet body; and (g) means for securing said flexible string means to said helmet body, said means for securing including an additional screw-threaded aperture in said helmet body, an annular portion secured to one end of said flexible string means, and screw means extending through said annular portion and screw-threadedly received in said additional screw-threaded aperture for securing said one end of said string means to said helmet body.

8. A safety helmet according to claim 4; wherein said means for securing includes string connecting means secured to said helmet body for securing one end of said flexible string means thereto.

9. A safety helmet according to claim 8; wherein said string connecting means is secured to said helmet body by means of an adhesive.

* * * * *